US009856103B2

(12) United States Patent
Perini

(10) Patent No.: US 9,856,103 B2
(45) Date of Patent: Jan. 2, 2018

(54) DEVICE AND METHOD FOR CONTROLLING THE SEPARATION OF SHEETS OF PAPER WEBS IN REWINDING MACHINES AND A REWINDING MACHINE PROVIDED WITH SUCH A DEVICE

(71) Applicant: FUTURA S.P.A., Capannori (LU), Fraz. Guamo (IT)

(72) Inventor: Fabio Perini, Viareggio (IT)

(73) Assignee: FUTURA S.P.A., Fraz, Guamo (IT)

( * ) Notice: Subject to any disclaimer, the term of this patent is extended or adjusted under 35 U.S.C. 154(b) by 133 days.

(21) Appl. No.: 14/912,500

(22) PCT Filed: Aug. 18, 2014

(86) PCT No.: PCT/IT2014/000222
§ 371 (c)(1),
(2) Date: Feb. 17, 2016

(87) PCT Pub. No.: WO2015/040645
PCT Pub. Date: Mar. 26, 2015

(65) Prior Publication Data

US 2016/0194169 A1 Jul. 7, 2016

(30) Foreign Application Priority Data

Sep. 23, 2013 (IT) ..... FI2013A0222

(51) Int. Cl.
*B65H 19/26* (2006.01)
*B65H 19/22* (2006.01)
*B65H 19/28* (2006.01)

(52) U.S. Cl.
CPC ..... *B65H 19/267* (2013.01); *B65H 19/2269* (2013.01); *B65H 19/28* (2013.01);
(Continued)

(58) Field of Classification Search
CPC .... B65H 19/26; B65H 19/267; B65H 19/283; B65H 19/2269; B65H 19/28; B65H 2406/33; B65H 2406/122
See application file for complete search history.

(56) References Cited

U.S. PATENT DOCUMENTS 4,327,877 A * 5/1982 Perini ..... B65H 19/2269 242/521
4,487,377 A * 12/1984 Perini ..... B26F 3/002 242/521

(Continued)

FOREIGN PATENT DOCUMENTS

EP 524158 A1 1/1993
EP 694020 B1 7/1997

(Continued)

*Primary Examiner* — William A. Rivera
(74) *Attorney, Agent, or Firm* — McGlew and Tuttle, P.C.

(57) ABSTRACT

Device for controlling the separation of the sheets of paper webs rolled in the form of logs, comprising a guide roller (RA) cooperating with further means (R4, R5) for rolling a paper web (2) so as to form a paper log and cooperating with means for providing pre-incision lines on the paper web (2) so as to divide it in multiple separable sheets. The device comprises pneumatic separation means (SP) adapted to direct a fluid jet (J) toward a pre-incision line (p) which separates the last sheet (LS) of a log (RO) in the course of formation from the first sheet (FS) of a subsequent log to be formed. The pneumatic separation means (SP) are inside the guide roller (RA) and the latter has an outer surface (72) with a plurality of through holes (73) allowing the fluid jet (J) produced by the pneumatic separation means (SP) to be directed towards the pre-incision lines (p). The device comprises suction means (200, 201) arranged downstream of the separation means (SP) relative to a direction (K) of rotation of the guide roller (RA). The suction means (200,
(Continued)

201) are inside the guide roller (RA). The suction means (200, 201) provoke a suction through the holes (73).

8 Claims, 5 Drawing Sheets

(52) U.S. Cl.
CPC ..... *B65H 19/283* (2013.01); *B65H 2406/122* (2013.01); *B65H 2406/33* (2013.01)

(56) References Cited

U.S. PATENT DOCUMENTS 5,639,046 A * 6/1997 Biagiotti ..... B65H 18/28 242/541.2
5,979,818 A 11/1999 Perini et al.
7,172,151 B2 * 2/2007 Biagiotti ..... B65H 19/2269 242/521
8,011,612 B2 * 9/2011 Gelli ..... B65H 19/2269 242/532.2
8,186,612 B2 * 5/2012 Gelli ..... B65H 19/29 242/532
8,302,900 B2 * 11/2012 Gambini ..... B65H 19/2269 242/532.2
8,979,012 B2 * 3/2015 Tsai ..... B65H 19/2269 242/521
2006/0169733 A1 * 8/2006 Perini ..... B65H 19/267 225/93
2008/0283656 A1 * 11/2008 Gelli ..... B65H 19/2269 242/521
2010/0060693 A1 * 3/2010 Sugahara ..... B41J 3/60 347/16
2011/0133015 A1 6/2011 Gelli et al.
2013/0056574 A1 * 3/2013 Li ..... B65H 19/2276 242/541.2
2015/0020976 A1 * 1/2015 Yen ..... B65H 19/29 156/361

FOREIGN PATENT DOCUMENTS

EP 1700805 A2 9/2006
EP 2 032 488 A2 3/2009
EP 2 202 187 A1 6/2010
GB 2105688 A 3/1983
WO 2004/005172 A1 1/2004
WO 2007141818 A2 12/2007

* cited by examiner

DEVICE AND METHOD FOR CONTROLLING THE SEPARATION OF SHEETS OF PAPER WEBS IN REWINDING MACHINES AND A REWINDING MACHINE PROVIDED WITH SUCH A DEVICE

The present invention relates to a device and a method for controlling the separation of sheets of paper webs in rewinding machines and a rewinding machine provided with such a device.

It is known that the production of paper logs involves feeding a continuous web of paper along a predefined path. At a preset point of said path, the web is subject to a transverse discontinuous incision that forms a pre-cut line apt to subdivide the paper web into portions or sheets of predetermined length that can be torn off.

This known technique involves the use of tubular elements in paperboard (commonly called cores) on whose surface is distributed a predetermined amount of glue to enable the bonding of the first sheet of the log to be formed. It also provides for the use of winding rollers, positioned and acting in a forming station, which cause the rotation of the core on which is wound the paper. The process of formation of a log is completed after the winding of a predetermined amount of paper on the core. At this point, the machine switches to the formation of the next log. At the end of the formation process is necessary to glue the last sheet of each log to the one below in order to avoid the spontaneous unwinding of the log. This type of gluing is defined as "edge closing". When on the log in the logs formation station there are wrapped a predetermined number of sheets, provision is made for interrupting the paper web and, more precisely, provision is made to separate the last sheet of the log in formation from the first sheet of the next log to be formed.

EP 1700805 discloses a device for causing the tearing of a paper web at the end of the logs formation process. This device comprises, essentially, a battery of nozzles located internally to a paper driving roller placed in the logs forming station, which nozzles, with a predetermined rate, direct a jet of compressed air towards a pre-incision or pre-cut line that separates the last sheet of the log being formed from the first sheet of the next log to be formed. The separation of these sheets is determined by the action exerted by the compressed air on said pre-cut line.

The main purpose of the present invention is to further increase the range of use of a pneumatic device of the type indicated above.

This result is achieved, according to the present invention, by adopting the idea of realizing a device and implement an operating method having the characteristics indicated in the independent claims. Other features of the invention are the subject of the dependent claims.

The advantages deriving from the present invention consist essentially in that it is always possible to ensure the highest accuracy in causing the tearing of the paper web, irrespective of the paper web feed rate, guaranteeing always the proper guidance of the same web in the logs forming station. Furthermore, it is always guaranteed the proper guidance of each edge of the separate sheets, including the end edge of the last sheet of the log being formed in the logs formation station. Note, also, that a device in accordance with the invention is relatively simple, cheap and reliable even after a prolonged period of operation.

These and other advantages and features of the present invention will be best understood by anyone skilled in the art from the following description and with the help of the attached drawings given as a practical exemplification of the invention, but not to be considered in a limiting sense, wherein:

FIG. 1 schematically shows a rewinder provided with a device in accordance with the present invention;

FIG. 2 schematically shows a device in accordance with the present invention;

FIG. 3 is a detail of FIG. 2;

FIG. 4 schematically shows the flow of incoming and outgoing air from the driving roller "RA";

A device in accordance with the invention can be used within a rewinder structured in any way for what concerns the feeding and the sizing of the cores (1) and of the paper web (2) used for the production of logs. The rewinding machines are known to those skilled in the art and, therefore, are not described in greater detail. U.S. Pat. No. 4,487,377, EP 524158, GB 2105688, U.S. Pat. No. 5,979,818 and EP 694020 disclose as many examples of rewinding machines and reference can be made to these documents for a more extensive description of this kind of machines.

Figure 1:
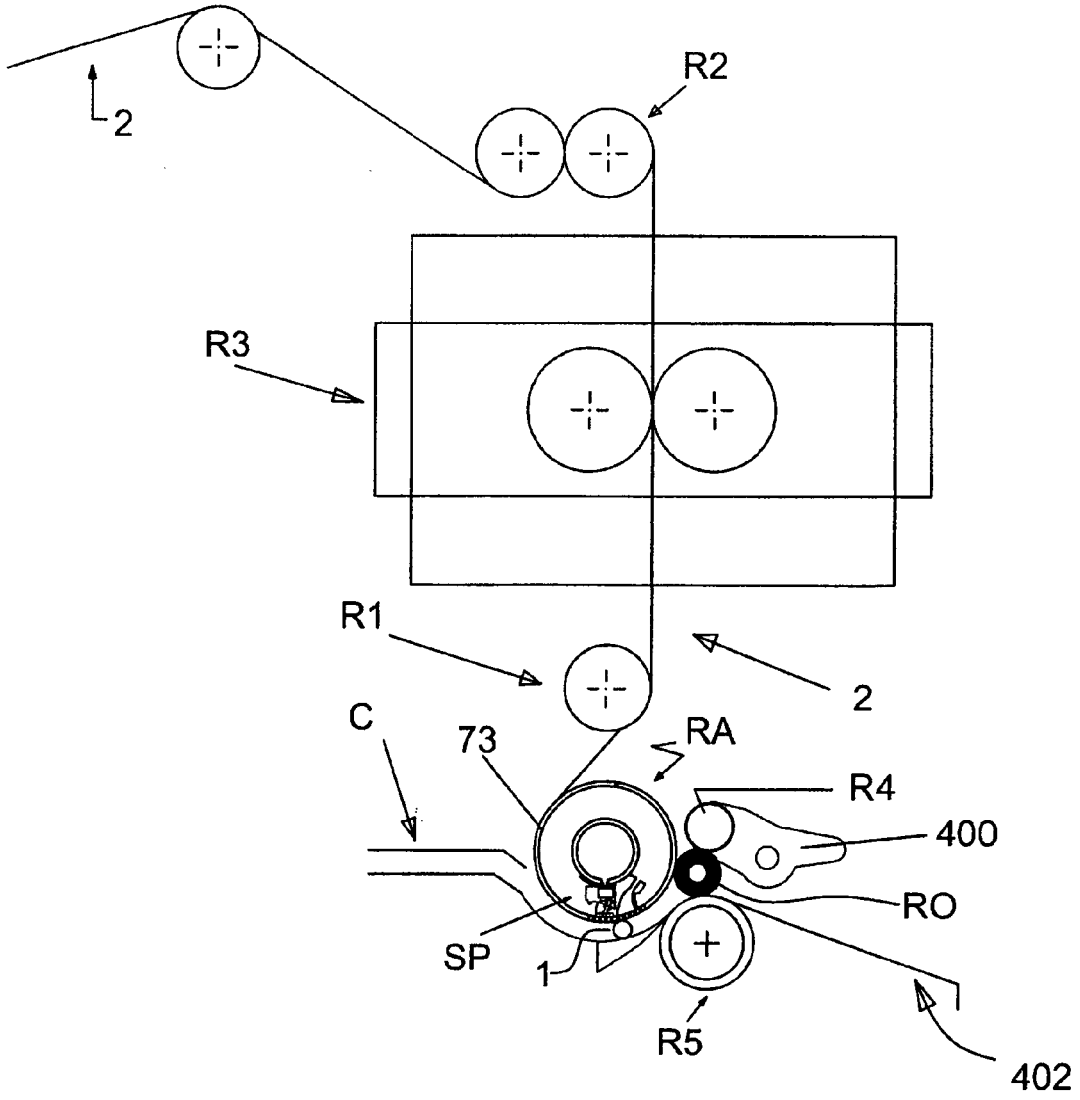

Essentially, as shown in FIG. 1, these machines comprise:

- means adapted for feeding and transversely pre-cutting a paper web (2), with more feeding, pre-cutting and driving rollers (R1, R2, R3) arranged along a predefined path;
- means adapted for winding the paper (2) on the cores (1), with a group of winding rollers (RA, R4, R5) two of which (R4, R5) are superimposed and positioned at the exit of a channel (C) along which advance the cores (1) from a store located upstream (not shown);
- means (not shown f) for the sizing of the paper web (2) and cores (1) in order to allow the glueing of the first sheet of each log (RO) on the corresponding core (1) and the glueing of the last sheet of each log (RO) on the underlying paper of the same log.

According to a method known to those skilled in the art, the paper web (2) travels along the path delimited by the rollers (R1, R2, R3, RA), is provided with transverse pre-incision or pre-cut lines, and is wound on the core (1*r*) in the station where are positioned the rollers (R4) and (R5) that, in cooperation with the roller (RA) and by rotating about the respective longitudinal axes, entail the winding of the paper web (2) on the core (1*r*). When on the latter a predetermined number of sheets (each sheet being delimited by two consecutive transverse perforations or pre-cut lines of the paper web 2) is wound, there is the intervention of means adapted to cause the tearing of the paper web (2) at a point of the channel (C) located between a new core (1) introduced into the same channel (C) and the station for the formation of logs (RO) where the rollers (R4, R5) are located and acting. The tearing is operated in correspondence of a perforation or pre-cut line (p) which separates the last sheet of the log (RO) being formed from the first sheet of the next log to be formed. Subsequently, the roller (R4), which is mounted on a rotating arm (400) associated with a corresponding actuator, is moved away from the roller (R5) to release the underlying log (RO) and allow its removal along a discharge plane (402) located downstream. At this point, the new core (1) which, while the formation of the log (RO) is completed moves forward and rolls along the channel (C) due to the contact with the roller (RA), takes the place of the previous one (1*r*) and the cycle is repeated identically.

It is understood, however, that for the purposes of the present invention said means for feeding the cores and the paper web, the means for perforating the paper web paper, the means for sizing the cores and the a paper web and the means for discharging the logs can be made and arranged in any possible way. The foregoing description is provided for illustrative purposes only and is not to be construed in a limiting sense.

In accordance with the invention, for causing the tearing of the paper web (2) in correspondence of the passage of a perforation or pre-cut line (p) which separates the last sheet of the log in formation from the first sheet of the next log to be formed, provision is made for means (SP) adapted to direct a fluid jet, such as a jet of compressed air, toward the said line (p) and the effect of which—with the possible cooperation of the roller (R4) that at a stage immediately preceding can be accelerated to tension the paper web (2) in the area affected by the jet—the tearing of the paper web (2) in correspondence of the line (p) is caused.

Figure 2:
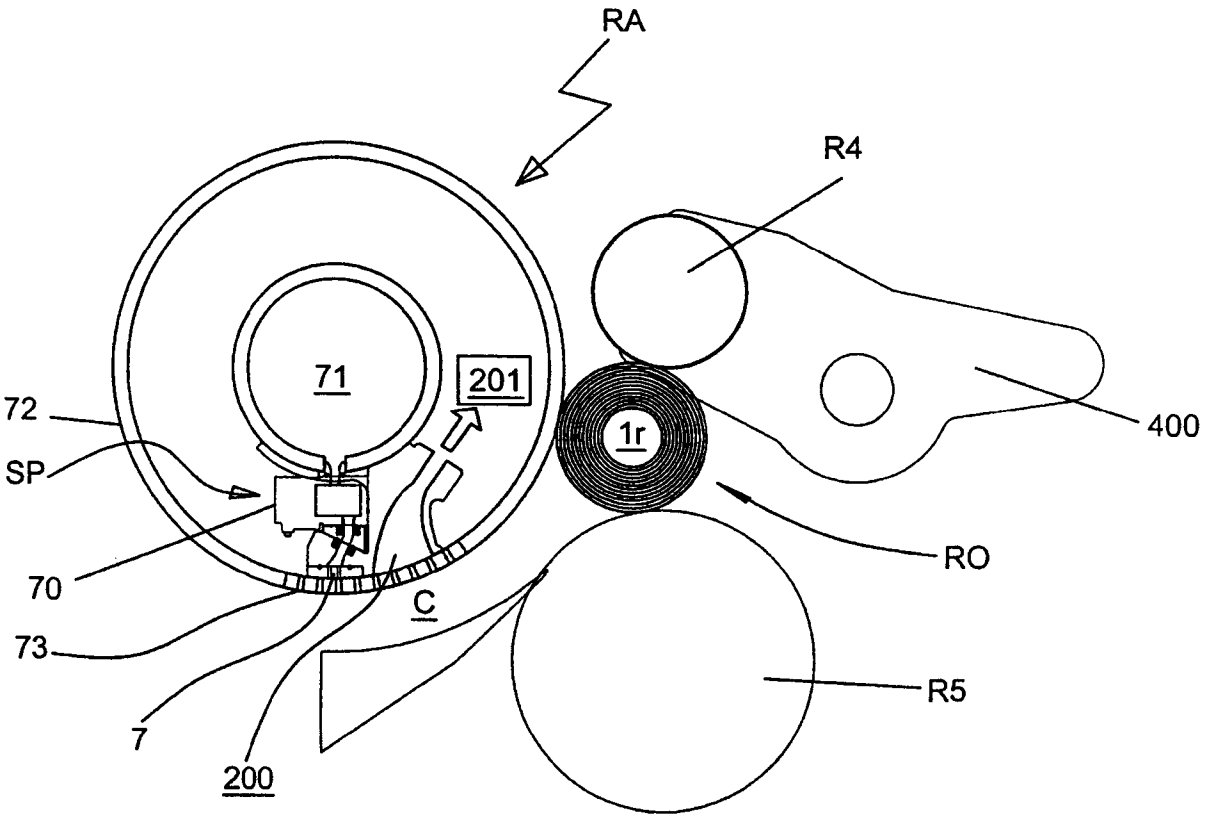
Figure 5:
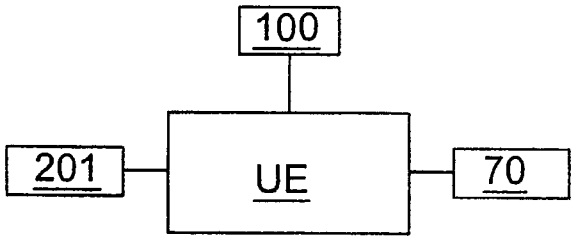
FIG. 5 is a simplified block diagram concerning the control of solenoid valves (70) and aspirator (201)

For example, with reference to the example illustrated in FIG. 2, the said pneumatic means (SP) comprise a battery of nozzles (7) connected, by means of corresponding solenoid valves (70), to a compressed air tank (71); said nozzles (7), with the respective solenoid valves (70) and the reservoir (71) are positioned inside the roller (RA) whose outer surface is delimited by a tubular jacket (72) with a plurality of through holes (73) through which the nozzles (7) are free to act. The nozzles (7) are connected to the solenoid valves (70) by means of respective ducts (74).

The said tubular jacket (72) rotates about its longitudinal axis while the said reservoir (71) is fixed and coaxial to the same jacket (72).

Figure 6:
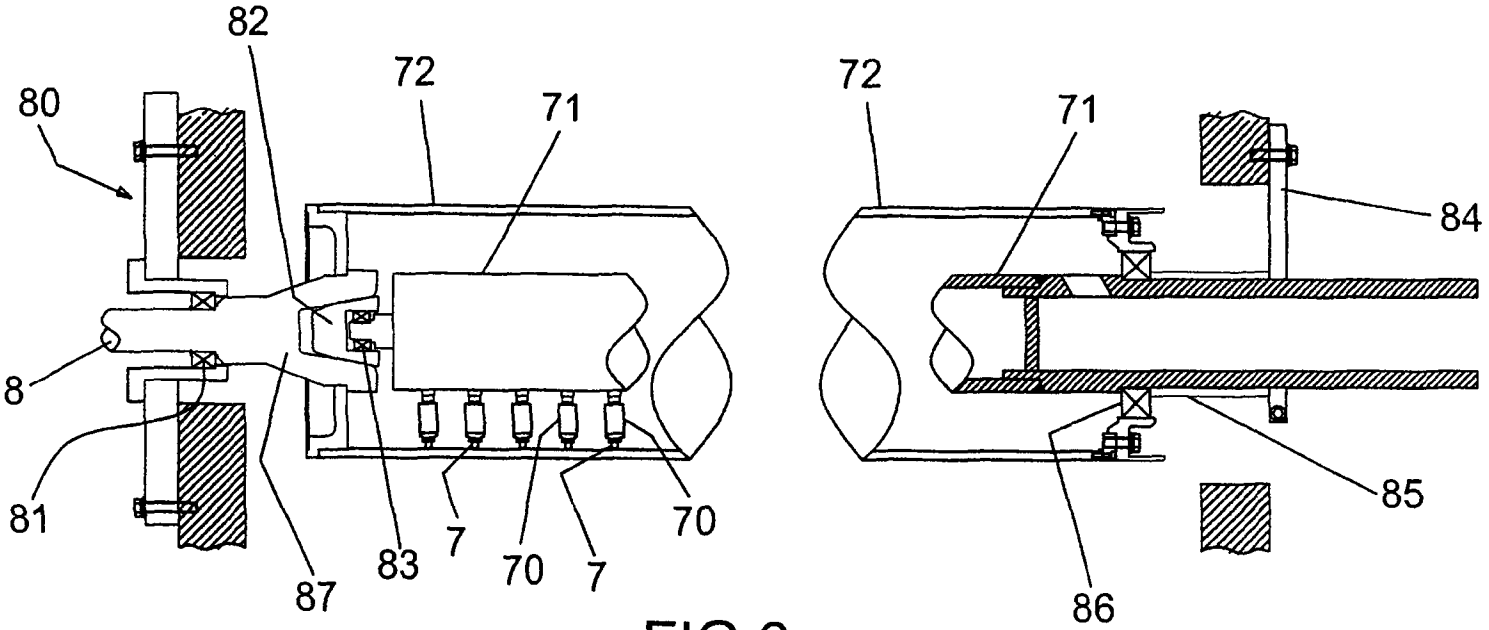
FIG. 6 is a partial longitudinal sectional view of the roller RA showing, in particular, the position of the jacket (72) and the tank (71).

For this purpose, as shown in FIG. 6, the jacket (72) is provided with a shaft (8), with a head flange (87), which is supported by the fixed part (80) of the machine with the interposition of a bearing (81) and is associated with a corresponding motor member (not shown).

Internally, said flange (87) has a housing for a conical cap (82) inside which is housed, with the interposition of a corresponding bearing (83), an axial appendix of the tank (71).

On the opposite side, the tank (71) is integral with the fixed part (84) of the machine and on the tank is placed a sleeve (85); the jacket (72) is coaxially mounted on the latter with the interposition of a corresponding bearing (86).

The solenoid valves (70) are activated, so as to enable the flow of compressed air from the tank (71) through the nozzles (7), when, for example at the attainment of a predetermined number of revolutions or fractions of revolutions of the incision rolls (R3), there is the passage of the perforation or pre-cut line (p) which separates the last sheet (LS) of the log (RO) being formed from the first sheet (FS) of the next log to be formed in front of the nozzles (7).

The resulting tearing action is fast and accurate. The control of the number of revolutions of the perforator rollers (R3) can be operated by means of a control device (100), such as a tachometer or an encoder, applied on the axis of one of the same rollers (R3).

The activation of the solenoid valves (70) can be automated by means of a programmable electronic unit (EU) which sends electrical activation and respectively deactivation signals to the solenoid valves (70) in response to electrical signals coming from the control device (100). The said programmable electronic unit (UE) is of the type known to those skilled in the art of industrial automation and, therefore, is not described in further detail.

Preferably, the nozzles (7) positioned inside the roller (RA) are oriented radially with respect to the same roller (RA).

Figure 3:
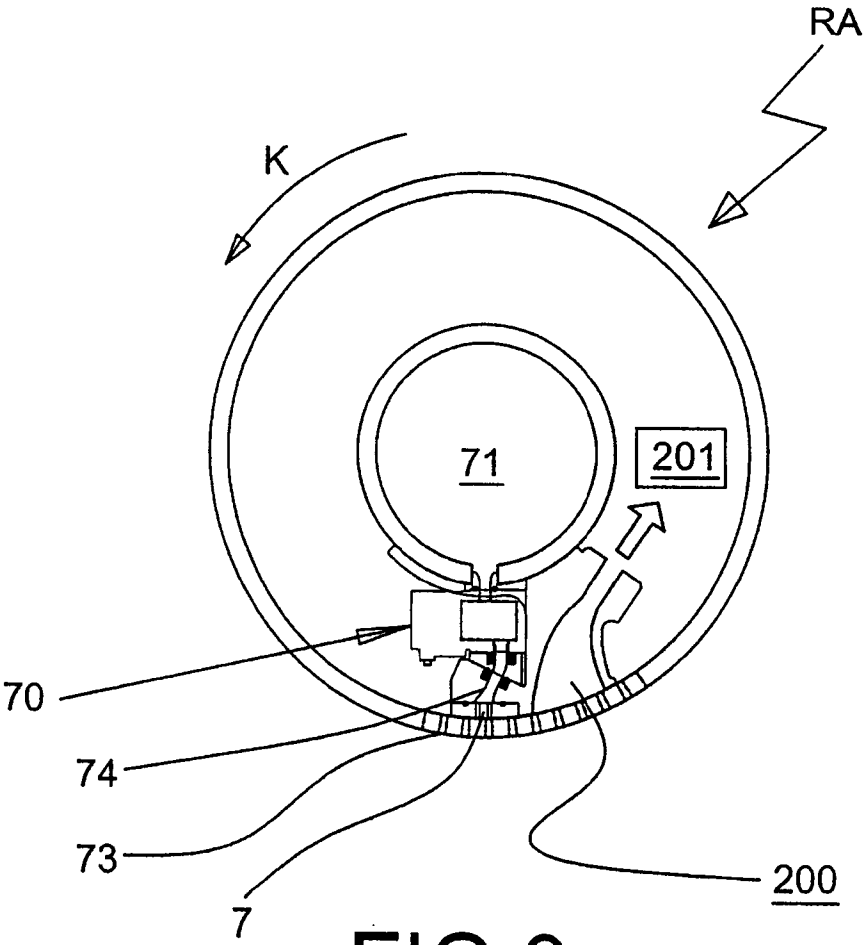
Figure 4:
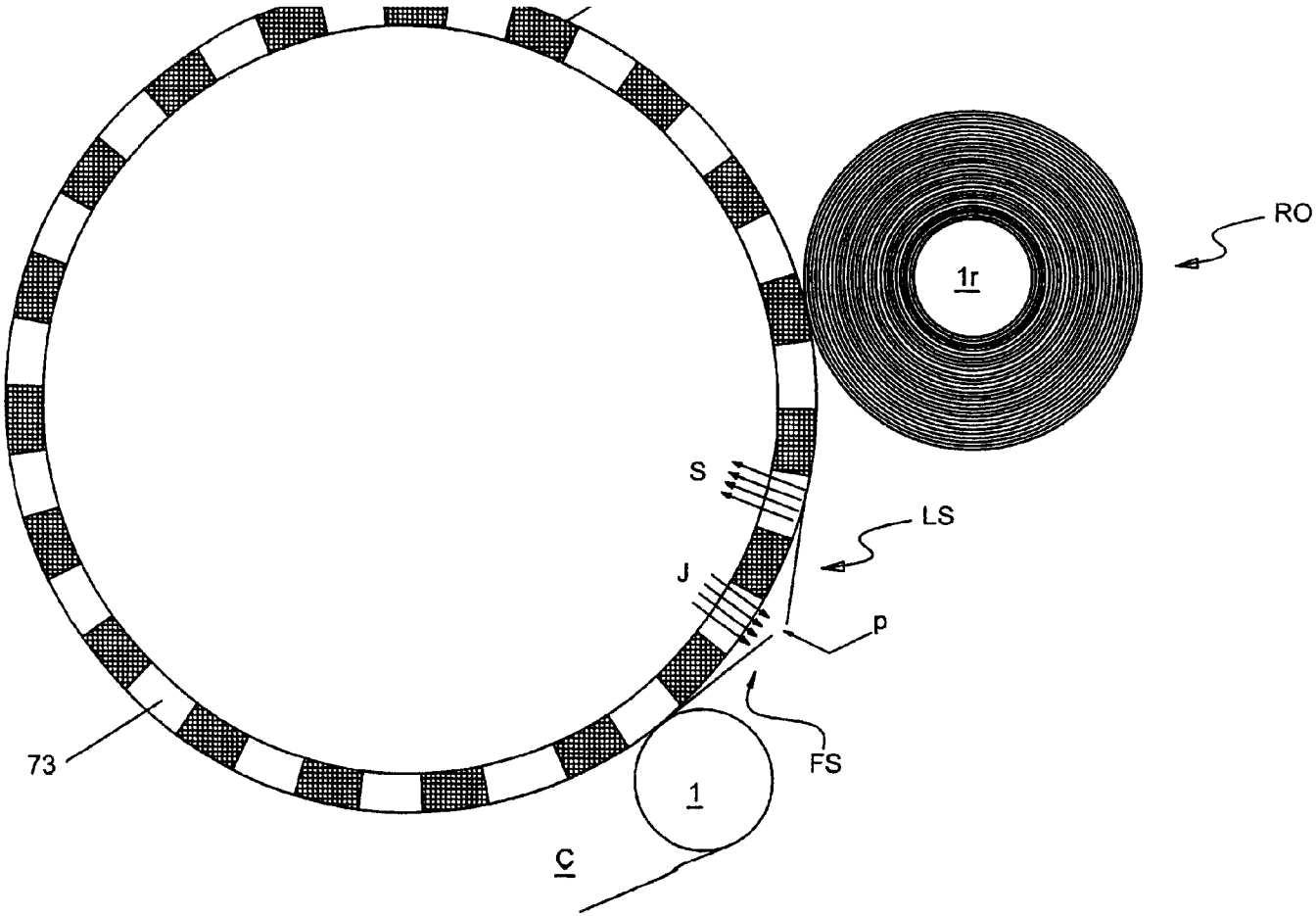

As shown in FIGS. 2-4, in the phase of completion of the process of winding of a paper web (2) around the core (1*r*) of the log (RO) in formation, the last sheet (LS) of the latter is attracted by suction means located downstream of the nozzles (7) relative to the direction (K) of rotation of the roller (RA).

The said suction means (200), placed inside the roller (RA), allow the adhesion of the last sheet of the log to the surface of the same roller (RA). In other words, the said last sheet remains bound to the roller (RA) downstream of the point where the nozzles (7) act. It is avoided, therefore, that the free end of the last sheet may bend on itself.

More particularly, with reference to the example shown in FIG. 2 and FIG. 3, the said suction means comprise a suction port (200) provided downstream of the battery of nozzles (7), i.e. to the right in the figures, inside the roller (RA). The suction port (200) is connected to an aspirator (201) through a corresponding duct (not visible in the drawings). Furthermore, the suction port (200) is positioned in the roller (RA) so as to be able to act through the holes (73) of the tubular jacket (72).

In practice, when the unit (EU) activates the solenoid valves (70), it also simultaneously activates the aspirator (201). Therefore, when the last sheet (LS) of the log (RO) being formed is separated from the first sheet (FS) of the next log to be formed due to the jet of compressed air delivered by the nozzles (7), the free end of the last sheet (LS) of the log (RO) being formed is attracted towards the roller (RA) instead of remaining free to possibly bend on itself. Alternatively, the aspirator (201) can be always in operation.

In the diagram of FIG. 4 the arrows "J" and "S" respectively indicate the flow of the air outgoing from the nozzles (7) and the flow of air sucked through the suction port (200).

Once completed the formation of the log (RO), it is released from the roller (R4) and can roll along the exit plane (402).

From the foregoing description it is evident that two adjacent portions of the surface of the roller (RA)—which in the example shown in the attached drawings serves both as a driving member for a paper web (2) and as a member adapted for winding the paper web (2) on the core (1*r*) in the logs formation station—are affected by a flow (J) of air that exit from the inside and at the same time by a flow (S) of incoming air.

An operating method for controlling the separation of the sheets of paper webs in rewinding machines in accordance with the present invention involves, therefore, a step of delivering a jet fluid (eg compressed air) through a first surface portion of a roller (RA) adapted for guiding a paper web (2) in a logs forming station of the logs and a step of air suction through a second surface portion of the same roller (RA) located downstream with respect to said first surface portion.

Preferably, in accordance with the present invention, said first and said second surface portion are consecutive, i.e. the second surface portion is arranged immediately downstream of the first surface portion.

Alternatively, said first and said second surface portion are not consecutive.

In practice the details of execution may vary in any equivalent way as for what concerns the elements described and illustrated and their disposition, without leaving the scope of the adopted solution and thus remaining within the limits of the protection granted to the present patent.

The invention claimed is:

1. A device for controlling separation of sheets of paper webs rolled in a form of logs, arranged and acting in a station for formation of logs comprising a guide roller cooperating with further means for rolling of a paper web so as to form a paper log and cooperating with a means for providing pre-incision lines on the paper web so as to divide the web in a plurality of separable sheets, the device comprising:

a pneumatic separation means for directing a fluid jet toward a pre-incision line which separates a last sheet of a log in a course of formation from the first sheet of a subsequent log to be formed, wherein said pneumatic separation means is positioned inside said guide roller, wherein said guide roller has an outer surface with a plurality of through holes allowing the fluid jet produced by the pneumatic separation means to be directed towards said pre-incision lines;

a suction means arranged downstream of said separation means relative to a direction of rotation of said guide roller, said suction means being placed within the guide roller in which is positioned the pneumatic separation means, and said suction means providing a suction through said through holes.

2. A device according to claim 1, wherein said suction means comprises a sleeve connected to an aspirator, the sleeve being positioned downstream of the pneumatic separation means.

3. A device according to claim 1, wherein said pneumatic separation means comprises a plurality of nozzles connected to a compressed air tank through solenoid valves.

4. A device according to claim 1, further comprising:

a programmable electronic unit controlling the suction means and the pneumatic means based on signals from a counter that counts a number of sheets wrapped on a log being formed.

5. A rewinding machine, comprising:

a device for controlling separation of sheets of paper webs rolled in a form of logs, arranged and acting in a station for formation of logs comprising a guide roller cooperating with further means for rolling of a paper web so as to form a paper log and cooperating with a means for providing pre-incision lines on the paper web so as to divide the web in a plurality of separable sheets, the device comprising:

a pneumatic separation means for directing a fluid jet toward a pre-incision line which separates a last sheet of a log in a course of formation from the first sheet of a subsequent log to be formed, wherein said pneumatic separation means is positioned inside said guide roller, wherein said guide roller has an outer surface with a plurality of through holes allowing the fluid jet produced by the pneumatic separation means to be directed towards said pre-incision lines;

a suction means arranged downstream of said separation means relative to a direction of rotation of said guide roller, said suction means being placed within the guide roller in which is positioned the pneumatic separation means, and said suction means providing a suction through said through holes.

6. An operating method for controlling separation of sheets of paper webs in rewinding machines, the method comprising:

dispensing a fluid jet through a first surface portion of a roller for guiding a paper web in a forming station of logs and sucking air through a second surface portion of the roller located downstream with respect to said first surface portion.

7. An operating method according to claim 6, wherein said first surface portion and said second surface portion are consecutive.

8. An operating method according to claim 6, wherein said first surface portion and said second surface portion are not consecutive.

* * * * *